US007346941B1

(12) United States Patent
Ein

(10) Patent No.: US 7,346,941 B1
(45) Date of Patent: Mar. 25, 2008

(54) BARIATRIC PATIENT LIFT APPARATUS

(76) Inventor: Robert John Ein, P.O. Box 4307, Lexington, KY (US) 40544-4307

( * ) Notice: Subject to any disclaimer, the term of this patent is extended or adjusted under 35 U.S.C. 154(b) by 322 days.

(21) Appl. No.: 11/176,146

(22) Filed: Jul. 7, 2005

Related U.S. Application Data

(60) Provisional application No. 60/601,832, filed on Aug. 16, 2004, provisional application No. 60/592,905, filed on Jul. 31, 2004.

(51) Int. Cl.
*A61G 7/14* (2006.01)
*A61G 7/10* (2006.01)

(52) U.S. Cl. ..... 5/83.1; 5/86.1; 5/81.1 R

(58) Field of Classification Search ..... 5/83.1, 5/85.1, 86.1, 87.1, 89.1, 81.1 R
See application file for complete search history.

(56) References Cited

U.S. PATENT DOCUMENTS

| | | | | | |
|---|---|---|---|---|---|
| 2,375,907 | A | * | 5/1945 | Farmer | 5/86.1 |
| 3,629,880 | A | * | 12/1971 | van Rhyn | 5/83.1 |
| 3,931,956 | A | * | 1/1976 | Hawkins | 254/8 B |
| 4,680,819 | A | * | 7/1987 | James | 5/83.1 |
| 4,682,377 | A | * | 7/1987 | Reich | 5/83.1 |
| 4,703,523 | A | * | 11/1987 | James | 5/83.1 |
| 4,918,771 | A | * | 4/1990 | James | 5/87.1 |
| 5,022,106 | A | * | 6/1991 | Richards | 5/86.1 |
| 5,148,559 | A | * | 9/1992 | Morris | 5/86.1 |
| 5,257,425 | A | * | 11/1993 | Shinabarger | 5/87.1 |
| 5,309,584 | A | * | 5/1994 | Parker | 5/87.1 |
| 5,365,621 | A | * | 11/1994 | Blain | 5/87.1 |
| 5,369,821 | A | * | 12/1994 | Richards et al. | 5/86.1 |
| 5,412,820 | A | * | 5/1995 | Richards | 5/86.1 |

(Continued)

FOREIGN PATENT DOCUMENTS

EP 241096 A2 * 10/1987

(Continued)

*Primary Examiner*—Robert G. Santos

(57) ABSTRACT

As the obesity rate climbs nationwide, obese and morbidly obese patients will continue to pose special lifting challenges to the healthcare industry. Obesity among American adults has nearly doubled during the past two decades. One in 80 men weights >300 pounds and one in 200 women weights >300 pounds. Getting assistance is crucial when moving these patients. With these rising numbers, have come the numerous complications relating to medical treatment for these bariatric patients. Healthcare providers must consider the additional costs associated with handling of the bariatric patient along with safety issues relating to both the bariatric patient and caregiver. Also, moving extremely obese patients can prove to very dangerous or even fatal. The most economical assistance to move bariatric patients to and from the hospital bed can only be provided by some mechanical aid. The management of bariatric patients produces special challenges, and the best way to ensure safe patient handling is through the use of special mechanical equipment that meet the size and weight requirements of these bariatric patients and that can be operated in very confined spaces. The target population is estimated to be the 4.5 million extremely obese persons in the United States, with a Body Mass Index (BMI) >35 that will become patients in some health care facility. The Centers for Disease Control (CDC) estimates that care for obese patients costs an average of 37 percent more than people of normal weight. In 2003, obesity-related medical costs in the US reached >$ 75 billion. This apparatus will be the first of its kind to incorporate adaptive control techniques to present-day assistive lift device designs.

19 Claims, 14 Drawing Sheets

U.S. PATENT DOCUMENTS

| | | | | | |
|---|---|---|---|---|---|
| 5,526,541 | A * | 6/1996 | Massey et al. | 5/81.1 RP |
| 5,530,976 | A * | 7/1996 | Horcher | 5/89.1 |
| 5,560,054 | A * | 10/1996 | Simon | 5/86.1 |
| 5,644,805 | A * | 7/1997 | Horcher | 5/86.1 |
| 5,682,630 | A * | 11/1997 | Simon | 5/87.1 |
| 5,878,450 | A * | 3/1999 | Bouhuijs | 5/86.1 |
| 5,892,180 | A * | 4/1999 | Carey | 177/144 |
| 6,092,247 | A * | 7/2000 | Wilson | 5/86.1 |
| 6,119,287 | A * | 9/2000 | Phillips | 5/81.1 RP |
| 6,134,725 | A * | 10/2000 | Bouhuijs | 5/86.1 |
| 6,175,973 | B1 * | 1/2001 | Hakamiun et al. | 5/89.1 |
| 6,329,612 | B1 * | 12/2001 | von Schroeter | 177/144 |
| 6,367,103 | B1 * | 4/2002 | Collins | 5/86.1 |
| 6,389,619 | B1 * | 5/2002 | Dunn | 5/86.1 |
| 6,430,761 | B1 * | 8/2002 | Brandorff et al. | 5/86.1 |
| 6,449,785 | B1 * | 9/2002 | Liljedahl | 5/89.1 |
| 6,557,189 | B2 * | 5/2003 | Von Schroeter | 5/86.1 |
| 6,568,002 | B1 * | 5/2003 | Liljedahl | 5/86.1 |
| 6,581,222 | B1 * | 6/2003 | Liljedahl | 5/89.1 |
| 6,665,894 | B2 * | 12/2003 | Moffa et al. | 5/86.1 |
| 6,718,573 | B2 * | 4/2004 | Von Schroeter | 5/86.1 |
| 6,806,430 | B2 * | 10/2004 | Downing | 177/144 |
| 6,857,144 | B1 * | 2/2005 | Huang | 5/86.1 |
| 7,020,913 | B2 * | 4/2006 | Van Scheppingen et al. | 5/86.1 |
| 2001/0027574 | A1 * | 10/2001 | Bouhuys | 5/86.1 |
| 2002/0002740 | A1 * | 1/2002 | Schroeter | 5/86.1 |
| 2003/0070227 | A1 * | 4/2003 | Schroeter | 5/86.1 |
| 2003/0208844 | A1 * | 11/2003 | Moffa et al. | 5/86.1 |
| 2005/0034231 | A1 * | 2/2005 | Huang | 5/86.1 |
| 2005/0210579 | A1 * | 9/2005 | Moffa et al. | 5/81.1 R |
| 2006/0137091 | A1 * | 6/2006 | Gramkow et al. | 5/86.1 |
| 2007/0000049 | A1 * | 1/2007 | White et al. | 5/84.1 |

FOREIGN PATENT DOCUMENTS

| | | | |
|---|---|---|---|
| EP | 399836 | A2 * | 11/1990 |
| GB | 1237808 | * | 6/1971 |
| GB | 2140773 | A * | 12/1984 |
| GB | 2177063 | A * | 1/1987 |

* cited by examiner

BARIATRIC PATIENT LIFT APPARATUS

This application claims the benefit of U.S. Provisional Application No. 60/592,905 filed Jul. 31, 2004 and U.S. Provisional Application No. 60/601,832 filed Aug. 16, 2004, incorporated by reference herein in their entirety.

BACKGROUND OF THE INVENTION

1. Technical Field

This invention relates to a portable patient lift apparatus for use by humans. More specifically, this invention relates to a portable lifting apparatus for assisting in lifting obese individuals in and out of a hospital bed or other locations and then transporting them to a different location.

Nursing staffs have the highest incidences of work-relate back problems of any occupation. The incidence rate continues to climb. Work-related musculoskeletal disorders (MSDs) account for a major portion of the cost of work-related injuries in the United States. A contributing factor is the fact that the American population has become one of the most overweight in the world. Nearly 97 million American adults are overweight. Of the 97 million overweight American Adults, it is estimated that 4 million are severely obese [Body Mass Index {BMI}>35 and 1.5 million [BMI>40] are morbidly obese.

With these rising numbers of severely and morbidly obese individuals come numerous complications relating to medical treatment. Besides the cost issue, healthcare providers must consider the daunting safety implications for both the patient and caregiver. One specific problem lies in simply providing a means for these patients to be able to rise or sit on the hospital bed or other locations without the risk of harm to the patient and/or the caregiver performing this task.

The movement of bariatric patients (a medical term derived from the Greek word "baros" meaning weight) produces special challenges to health care professionals. Internationally, bariatric patient is defined as an individual that has a BMI>30. Many studies have shown that health care workers are at the greatest risk for musculoskeletal injuries when dealing with bariatric patients, particularly in the sit-to-stand transfer mode. The best way to ensure safe patient handling is through the use of specialized mechanical equipment that is designed to meet the size and weight requirements of the bariatric patient.

One of the main benefits of the apparatus is that it requires only a single person to perform the sit-to-stand transfer function of the bariatric patient, which in turn will reduce the resources expended to perform this task.

2. Description of the Prior Art

There are many types of mechanical lift mechanisms on the market for bariatric patient lifting. Some of the present designs are inherently unstable in nature because of their basic design philosophy. Others are extremely large and bulky and can not be used effectively in the bariatric patient's room. In others the inability to transfer bariatric patients from certain types of wheelchairs or other assistive items because they contain certain obstacles is inherent to their design. One of the functions of the proposed device is to provide controlled unassisted lifting movement for the user. The inability of some bariatric patients to provide any self induced lifting ability in a normal manner without the chance of a fall is a major limiting feature of present mechanical lift device designs.

There are at least 6 types of mechanical lift mechanisms on the market today. They range from he following: 1) Powered Hospital bed that converts to a chair (known as a Total Care Bed System®); 2) Permanently mounted powered ceiling system; 3) Permanently mounted powered wall system; 4) A mobile powered sling lift mechanical device; 5) Mobile powered lift/stand mechanical device; and 6) Powered Standing Frame mechanical device. However, each of these types has at least one major deficiency.

The majority of the lift systems are some type of a sling mechanism. The sling is subject to several types of failures. The FDA has reported that there have been more than 50 deaths and over 500 patients have been seriously hurt because of failure of sling type lift systems. The following is summation of failures that caused death or severe injuries: 1) The patient fell to the floor when the strap that attaches the sling to the lifting frame failed; 2) The patient fell to the floor when the gravity-activated locking clip which holds the strap to the lifting frame failed; 3) The patient fell to the floor because of the patient's movement within the sling allowed the sling to slip out of the spreader bar; 4) The patient fell to the floor because the sling that was used was too large for the patient; 5) The patient fell because the lifting frame failed because of excessive load; and 6) The patient fell to the floor because the lifting mechanism the raises and lowers the jib failed resulting the sudden drop of the jib.

The ceiling lift is one of the newest types of patient lift systems and has been available in the United States for several 5 years. The main disadvantages associated with the ceiling lift system are the installation of overhead tracks and failure and/or stoppage of the electric drive motor unit. A track must be procured and installed in each room that requires patient transfer capabilities. Room to room transfer with the ceiling lift system will be difficult. One problem is the removal of doorway headers and replacing them with some type of header assembly that will let the ceiling lift system pass from room to room but still provide privacy to the patient. Also load conditions on the ceiling and walls must be considered in the installation of this type of patient lifter.

The wall mounted lift system is similar to the ceiling lift system except the lifting motor unit is attached to a wall mounted jib rather than a track. The main disadvantages associated with the wall mounted lift system are the limited transfer range and failure and/or stoppage of the electric drive motor unit.

The powered mobile sling lift system also known as the Hoyer style lifter is the most commonly used. The main disadvantages associated with the powered mobile sling lift system are the ability of the caregiver to maneuver the lifter once a patient is loaded into the sling, failure jib mechanism and/or failure and/or stoppage of the electric lift motor unit.

A major problem with the use of any sling lift system is the fact that the patient requires a lift team (two or more caregivers who are training in proper lifting techniques) to move the bariatric patient on to and off the sling. Another problem is to provide the necessary force to move the lift mechanism to the desired location. To instruct the patient to remain motionless while being lifted to reduce the chance of lift mechanism instability is another concern.

The powered mobile sit/stand system differs from the three previous mentioned lift systems in the fact that the patient must be cognitive and provide some cooperative effort in the lifting task. The patient must possess some muscle tone in at least one lower limb, trunk and at least one upper limb. The main disadvantages associated with the mobile sit/stand system are the clearance required for the legs and/or maneuver the lifter once the patient is loaded on the lifter.

The powered standing frame system is similar to the mobile sit/stand system but it provides for a work area so that the patient can perform various tasks while standing without the fear of falling. The main disadvantages associated with the powered standing frame system are the ability of the caregiver to maneuver the system once a patient is standing in the device, failure of the control mechanism and/or failure and/or stoppage of the electric lift motor unit.

As mentioned above the Total Care Bed System® is not a lifting mechanism per se, it only positions the patient from a prone to sitting position but does not lift the patient out of the bed and transfer the patient to a new location.

SUMMARY OF THE INVENTION

Presently there are many techniques for providing maximum structural capabilities to patient lifting system designs. These patient lifting system designs have inherent deficiencies because of limited stability, mobility, space and ruggedness required in their use. The inability to acquire stress analysis data from these patient lifting system designs in a natural surrounding introduces some distortion in the data acquired and its interpretation of the data as a result of their inherent designs. In some cases it requires the tester to use cumbersome hardware and/or testing harness(s) in order to obtain the desired data for evaluation.

One of the unique features of this patient lifting system is that it allows the patient to maintain or increase muscle tone, range of motion and possibly optimize blood flow in the their extremities.

The apparatus uses a specialized drive wheel set to negotiate around various restrictive areas. The apparatus has steering and drive wheels, which are microprocessor controlled. In the storage mode the apparatus collapses into small mobile module that stands approximately 3 feet tall and base circumference approximately of 2 feet in diameter. When fully operational the device has approximately a maximum of 7 feet in height, appendages that have approximately a maximum reach of 4 feet and a base radius of approximately 3½ feet. The entire apparatus is motorized, which can operate on internal power source or external power. The caregiver operates the entire configuration by means of a remote controller, which is connected to microprocessor via a wireless datalink. This includes transformation from storage to operational mode, movement of the appendages, and movement of the device to various locations. The caregiver will determine direction, speed and location of the various appendages so as to lift the patient from one location and transport the patient to a different location by sending the appropriate control signal(s) to the various drive units that manipulate the various appendages and/or drive wheel. Each power drive unit consists primarily of a drive motor, gear reduction unit, coupling mechanisms and electronic control module. Steering is accomplished by control signals generated by the caregiver to drive a reversible DC brushless motor that rotates the rear drive wheel unit to the desired alignment direction. Also, a built-in power source such as lithium, Silver-Zinc, Alkali-Zinc batteries or some other power source [such as fuel cell(s), etc.] which provide the power required for each control module and various DC brushless motors. Power drive units could also be operated by means of hydraulics or similar power source rather than DC brushless motors except for the drive wheel portion.

The overall apparatus is designed for ease of use, transport and storage. In designing stability into the apparatus, overall effectiveness and safety was not compromised. The stability of the apparatus is determined and measured by the center of gravity and the resistance to tip-over the apparatus over any given terrain. The apparatus's weight plus the patient's weight upon the apparatus determines where the center of gravity will be for the apparatus. This new center of gravity and overall horizontal footprint will dictate if the apparatus will tip-over. The stability effectiveness of the apparatus is defined as the Apparatus's Stability Index (ASI). The higher the ASI, the less stable the apparatus becomes. As a general rule of thumb, a lower ASI not only equates to better stability of the apparatus but also indicates better performance on inclines, in non-stable surface (such as cracks, gap crossings, broken tiles, etc.).

From a stability perspective, the apparatus design offers the best solution for a versatile apparatus that is required to operate over diverse surfaces. This is because the design inherently provides a greater horizontal area (footprint) projection than standard mobile patient lift designs, resulting in a lower ASI. The design incorporates a very low ASI and uses weight reduction techniques such as hybrid composite materials. Size constraints were imposed during the design phase without compromise to safety. Design criteria have dictated that the overall apparatus is built for durability and safety. The apparatus's mobility will not be impacted by its traction ability over various surfaces (such as tile, cracks, gap crossings, broken tiles, etc.).

BRIEF DESCRIPTION OF THE DRAWINGS

Other objects and advantages of the present invention will become apparent from the following detailed description of the preferred embodiment of thereof taken in conjunction with the accompanying drawings, wherein.

DETAILED DESCRIPTION OF THE PREFERRED EMBODIMENTS

Figure 1:
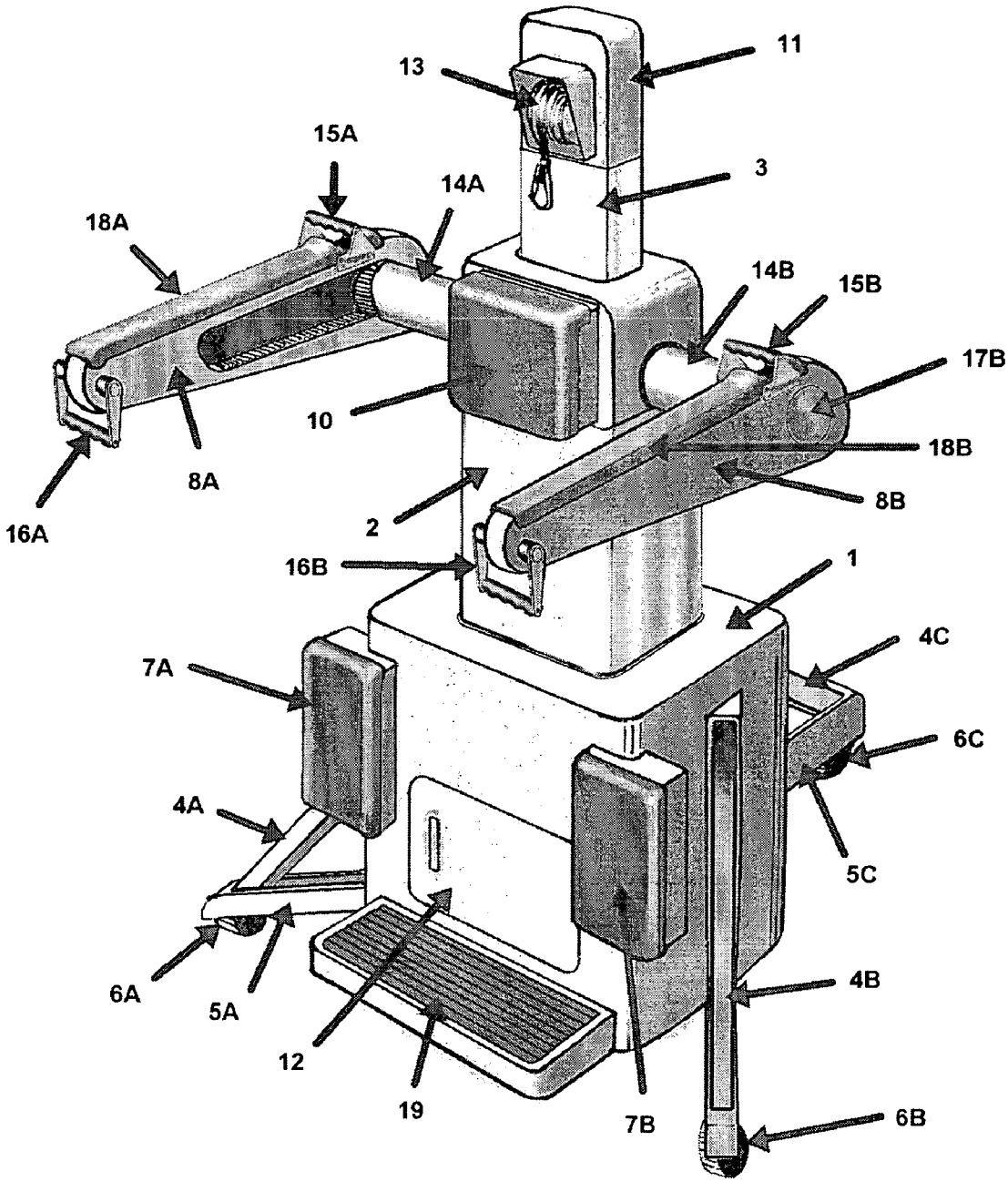
FIG. 1 is an overall view of the invention and depicts the apparatus in is fully extended mode configuration.
Figure 2A:
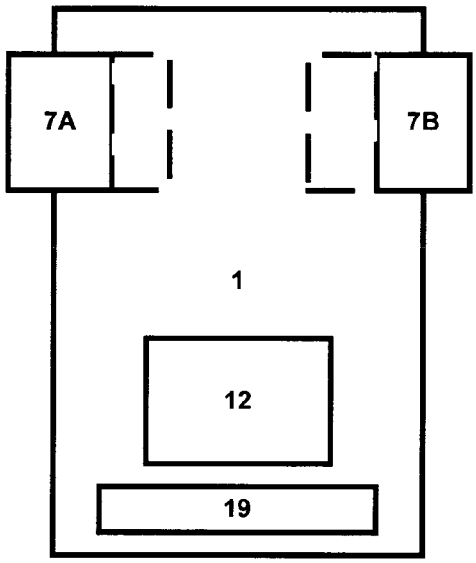
FIGS. 2*a*, 2*b*, 2*c* and 2*d* are schematic presentations of the front, left side, right side and back of the main trunk unit configuration.
Figure 2B:
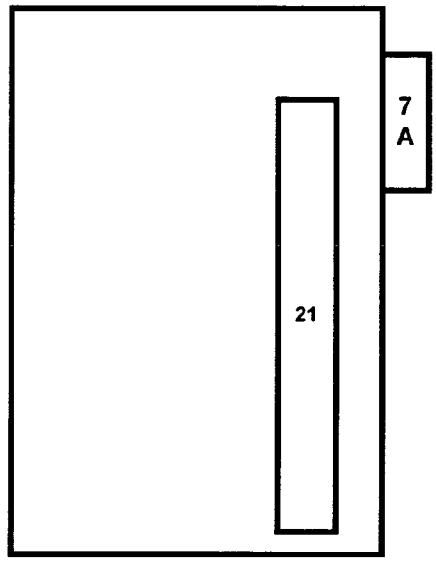
Figure 2C:
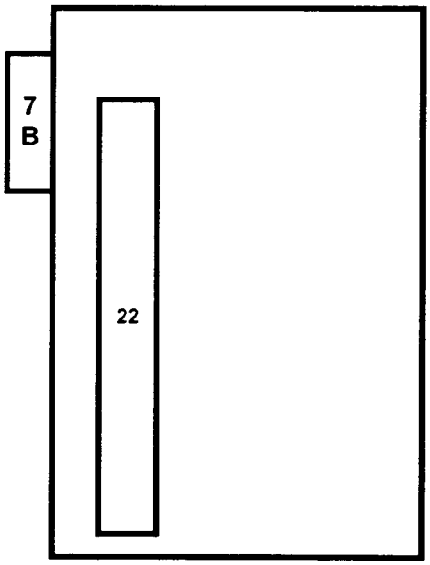
Figure 2D:
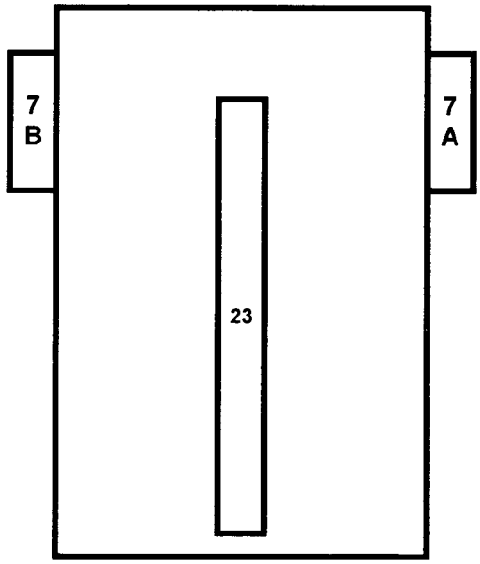
Figure 3A:
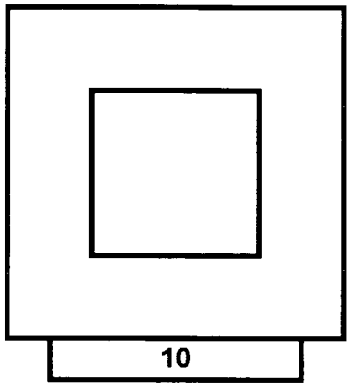
FIGS. 3*a*, 3*b*, 3*c* and 3*d* are schematic presentations of the top, left side, front, and right side of the middle trunk unit configuration.
Figure 3B:
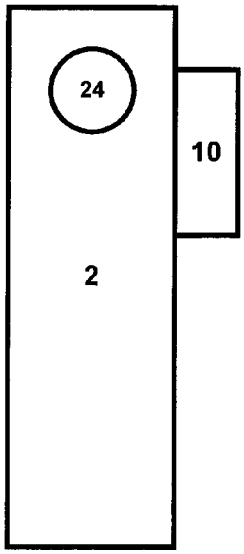
Figure 3C:
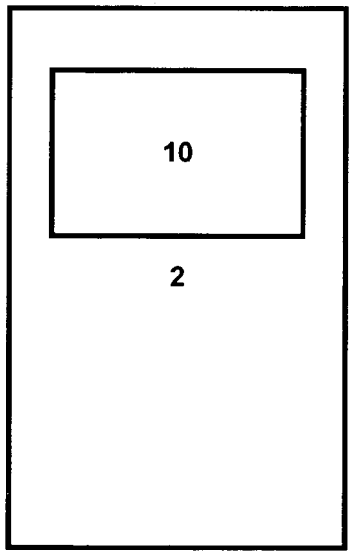
Figure 3D:
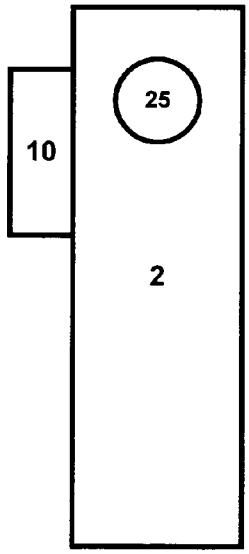
Figure 4A:
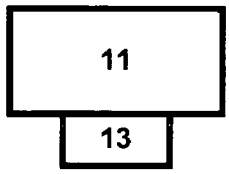
FIGS. 4*a*, 4*b*, 4*c* and 4*d* are schematic presentations of the top, left side, front, and right side of the upper trunk unit configuration.
Figure 4B:
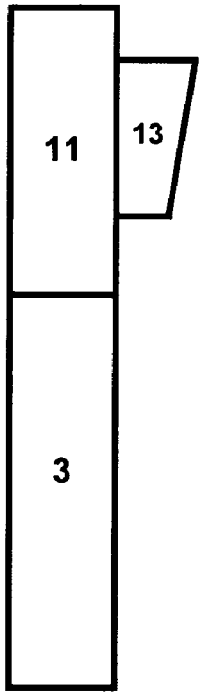
Figure 4C:
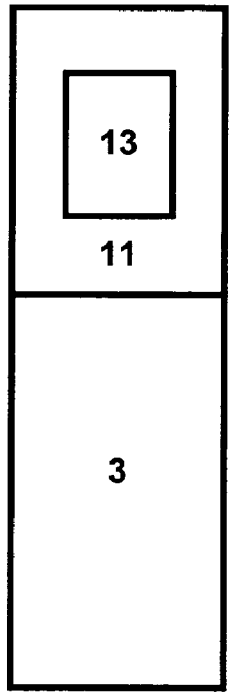
Figure 4D:
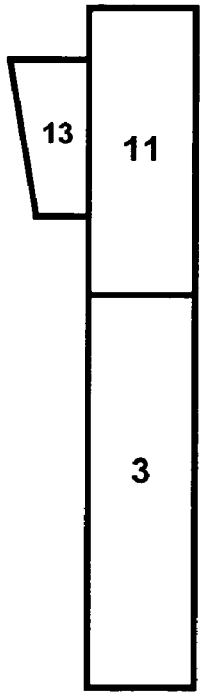

Referring now to the drawings, wherein identical numerals indicate identical parts, and initially to FIG. 1 which shows the profile view of the device in its maximum elevated position so the patient can rise from a seated position and then be located to another position.

The apparatus consists of a main trunk unit 1, a middle trunk unit 2 that is nested into the main trunk unit 1 along with the upper trunk unit 3 and which is nested into the middle trunk unit 2. Variable geometry stability fin units 4A, 5A, 4B, 5B {not shown}, 4C and 5C are attached to the main trunk unit 1. The weight, overall height of the patient that is to be lifted is programmed into the apparatus's microprocessor, which in turn determine the exact size of these stability fin units 4A, 5A, 4B, 5B {not shown}, 4C and 5C. The overall height of the invention is also controlled by the microprocessor. The patient's physical size and weight dictates what the lifting arm units 8A and 8B length will be and the spread distance between these lift arm units which is determined by the length of extender bar units 14A and 14B. Elbow joint units 17A {not shown} and 17B couples lifting arm units 8A and 8B to extender bar units 14A and 14B. On the main trunk unit 1 is a set of adjustable padded knee support units, 7A and 7B which are adjusted by the caregiver to fit the patient's proportions. The positioning of the middle trunk unit 2, upper trunk unit 3, stability fin units 4A, 4B and 4C, lifting arm units 8A and 8B, and extender bar units 14A and 14B is by reversible brushless DC motors with appropriate gearheads and various linkage mechanisms [not shown] which are in the control of the caregiver by means of a handheld control unit 409 {not shown} that has a wireless data link to a transceiver unit 419 {not shown}. The transceiver unit 419 {not shown} is internally connected to the microprocessor within the device. The apparatus maneuvers by means of wheel units 6A and 6B and steerable and reversible drive wheel unit 6C. The internal power source unit [not shown] and electronics control unit [not shown] are located in compartment 12. If the patient is lying on the bed he/she can grasp handle units 16A and 16B. The patient stands on footrest platform unit 19. Once standing the patient can switch to handle units 15A and 15B if desired. Arm pad units 18A and 18B provide cushioning. Attached to the upper trunk unit 3 is the patient's back harness winch holder unit 11 and winch unit 13. Also a chest protector pad unit 10 is mounted on the middle trunk unit 2.

Referring to FIGS. 2*a*, 2*b*, 2*c* and 2*d*, which shows the external views of the main trunk unit 1. The front external view of the main trunk unit 1 shows the footrest platform unit 19 and compartment door 12. Which allows access to the power source unit and electronic of the invention. The right side view shows opening 22 for the variable geometry stability fin unit A. The left side view shows opening 21 for the variable geometry stability fin unit B. The back side view shows opening 23 for the variable geometry stability fin unit C. Adjustable padded knee support units 7A and 7B are shown on the front and back views. While left side view shows padded knee support unit 7A and right side view shows padded knee support unit 7B.

FIGS. 3*a*, 3*b*, 3*c* and 3*d* shows the external views of the middle trunk unit 2. The front and top external views of the middle trunk unit 2 shows the chest protector pad unit 10. The right side view shows opening 25 for the extender bar unit 14B along with the chest protector pad unit 10. The left side view shows opening 24 for extender bar unit 14A along with the chest protector pad unit 10.

In FIGS. 4*a*, 4*b*, 4*c* and 4*d*, which shows the external views of the upper trunk unit 3. The front, right side and left side external views of the upper trunk unit 3 shows the winch holder unit 11 and winch unit 13. The top view shows the winch holder unit 11 along with the winch unit 13.

Figure 5:
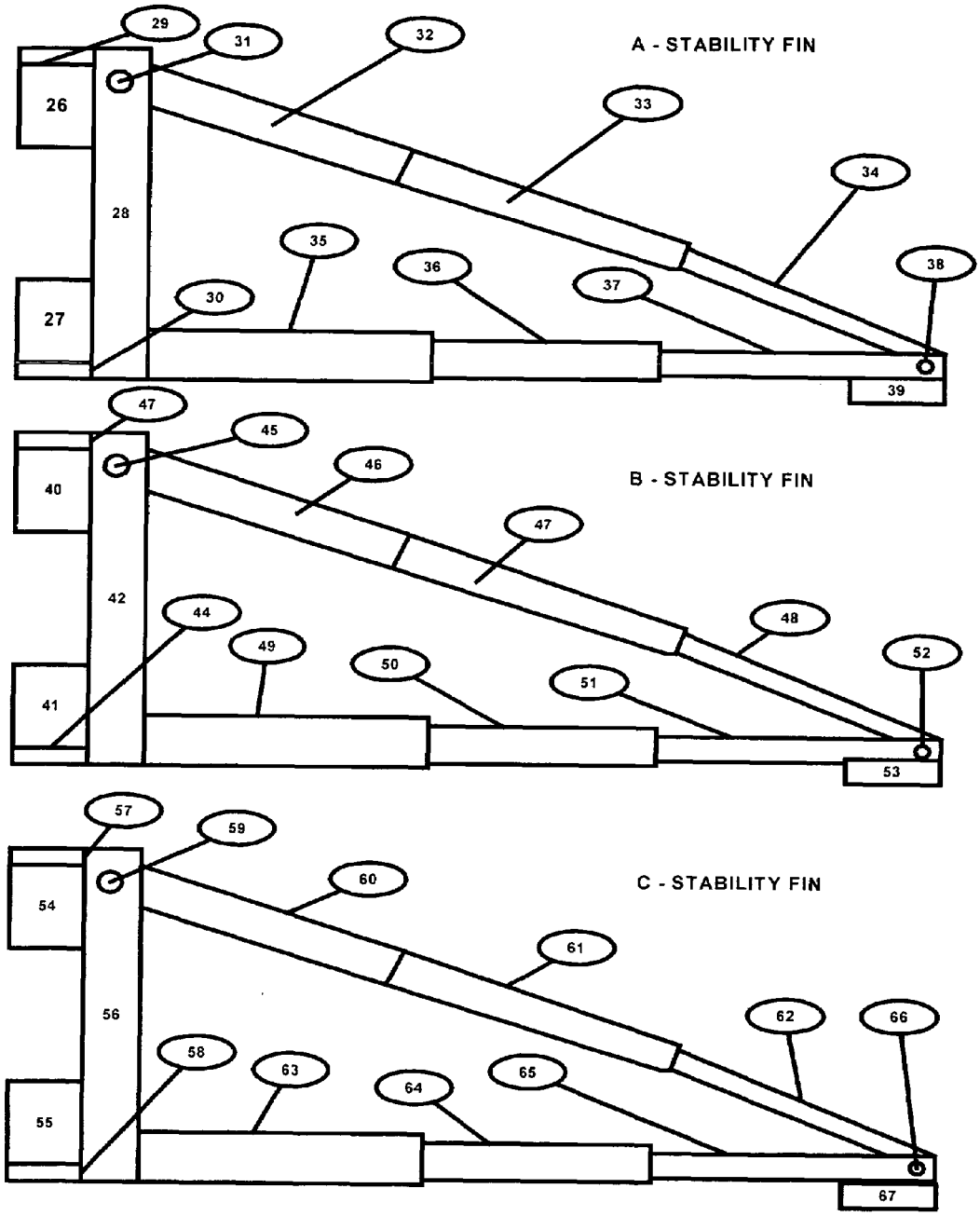
FIGS. 5*a*, 5*b* and 5*c* are schematic presentations of the three (3) variable geometry stability fin units of the invention.

FIGS. 5*a*, 5*b* and 5*c* are the external views of the variable geometry stability fin units. The side view of stability A fin shows the fixed length leg 28 along with expanding horizontal leg units 35, 36 and 37 which in FIG. 1 is denoted as 5A and expanding diagonal leg units 32, 33 and 34 which in FIG. 1 is denoted as 4A. Reversible DC motor with gearhead 27 with coupling gears, screw nuts and threaded rod assembly {not shown} which allows 4A and reversible DC motor with gearhead 27 with coupling gears, screw nuts and threaded rod assembly {not shown} which allows 4A and 5A to expand or contract at a predetermined rate as dictated by the apparatus's microprocessor. Included is connection unit 39, which holds wheel unit 6A. Likewise, stability B fin has a fixed length leg 42 along with expanding horizontal leg units 49, 50 and 51 which in FIG. 1 is denoted as 5B and expanding diagonal leg units 46, 47 and 48 which in FIG. 1 is denoted as 4B. Reversible DC motor with gearhead 40 with coupling gears, screw nuts and threaded rod assembly {not shown} which allows 4B and reversible DC motor with gearhead 41 with coupling gears, screw nuts and threaded rod assembly {not shown} which allows 4B and 5B to expand or contract at a predetermined rate as dictated by the apparatus's microprocessor. Included is connection unit 53, which holds wheel unit 6B. Also, stability C fin has a fixed length leg 56 along with expanding horizontal leg units 63, 64 and 65 which in FIG. 1 is denoted as 5C and expanding diagonal leg units 60, 61 and 62 which in FIG. 1 is denoted as 4C. Reversible DC motor with gearhead 54 with coupling gears, screw nuts and threaded rod assembly {not shown} which allows 4C and reversible DC motor with gearhead 55 with coupling gears, screw nuts and threaded rod assembly {not shown} which allows 4C and 5C to expand or contract at a predetermined rate as dictated by the apparatus's microprocessor. Included is connection unit 67, which holds wheel unit 6C. Connection plate 29 is used to secure stability fin A to the roof of main trunk unit 1 and connection plate 30 is used to secure stability fin A to the floor of the main trunk unit 1. Likewise, connection plate 47 is used to secure stability fin B to the roof of main trunk unit 1 and connection plate 44 is used to secure stability fin B to the floor of the main trunk unit 1. Also, connection plate 57 is used to secure stability fin C to the roof of main trunk unit 1 and connection plate 58 is used to secure stability fin C to the floor of the main trunk unit 1.

Figure 6A:
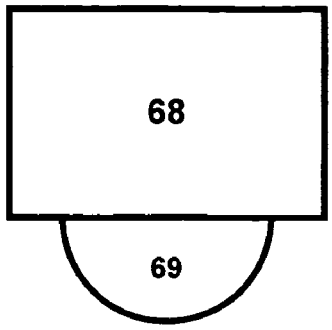
FIGS. 6*a*, 6*b* and 6*c* are schematic presentations of left side wheel unit, right side wheel unit and steerable drive wheel unit of the invention.
Figure 6B:
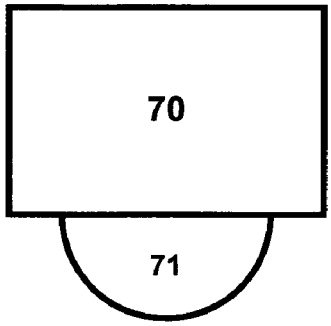
Figure 6C:
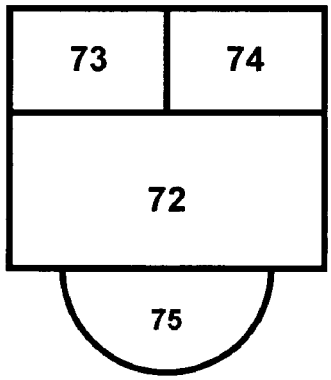

In FIGS. 6*a*, 6*b* and 6*c* are shown the external side view of wheel units 6A and 6B and drive wheel unit 6C. Wheel unit 6A consists of wheel 69 and wheel housing unit 68. Wheel housing unit 68 is connected to connection unit 39. Similarly, wheel unit 6B consists of wheel 71 and wheel housing unit 70. Wheel housing unit 70 is connected to connection unit 53. Also, drive wheel unit 6C consist of wheel 75 and wheel housing unit 72. Wheel housing unit 72 is connected to connection unit 67. Within wheel housing are the drive unit 73, which consists of a reversible DC motor gearhead linkage assembly {not shown} and steering unit

[74], which consists a reversible DC motor gearhead linkage assembly {not shown}. Appropriate control signals from the microprocessor operate the two DC motor units.

Figure 7A:
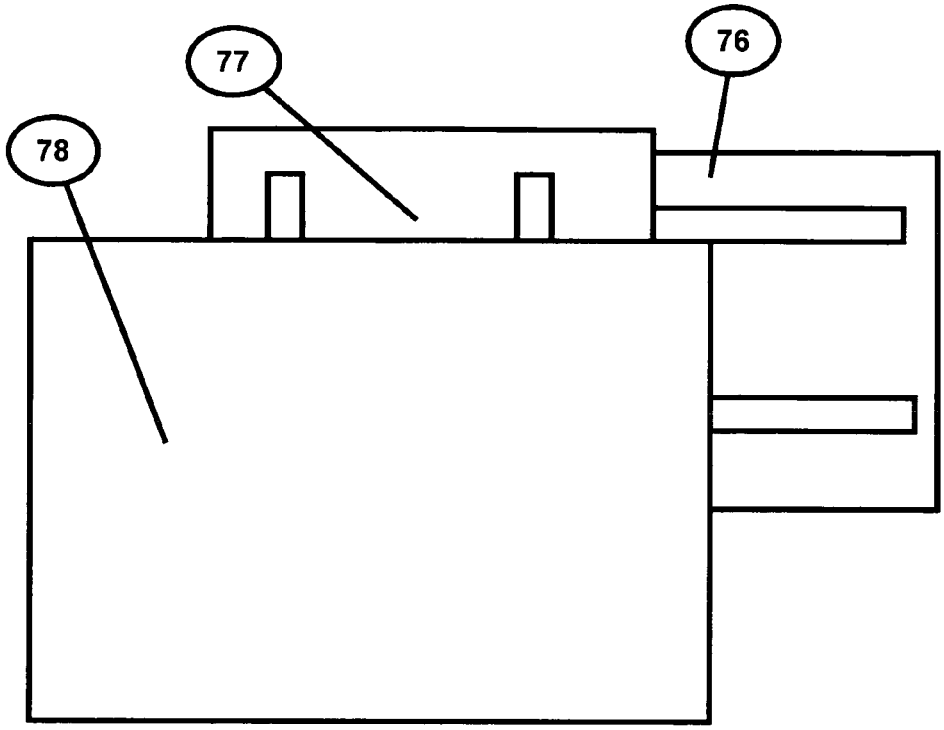
FIGS. 7*a* and 7*b* are schematic presentations of the left side adjustable knee support unit and the right side adjustable knee support unit of the invention.
Figure 7B:
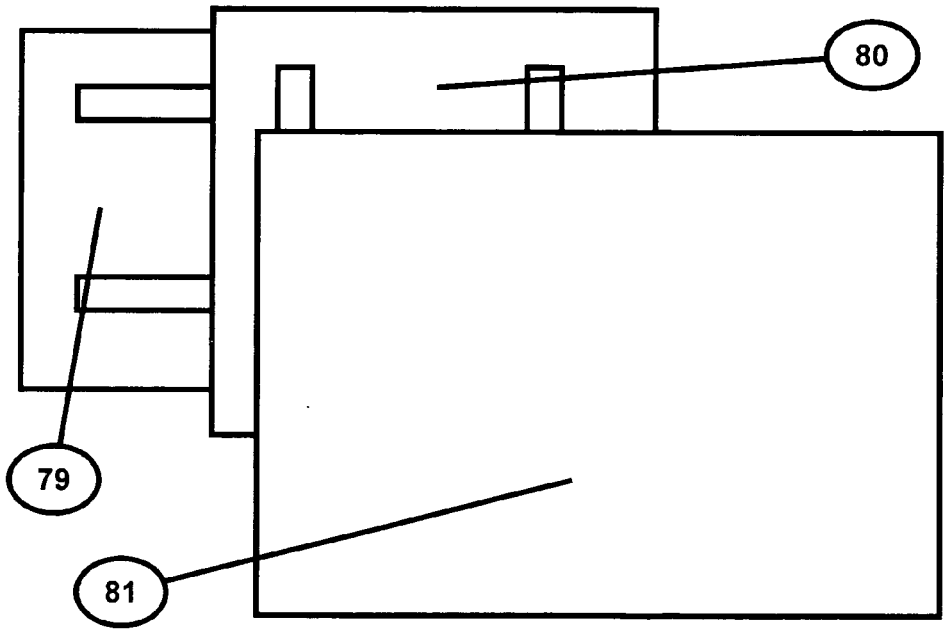
Figure 8A:
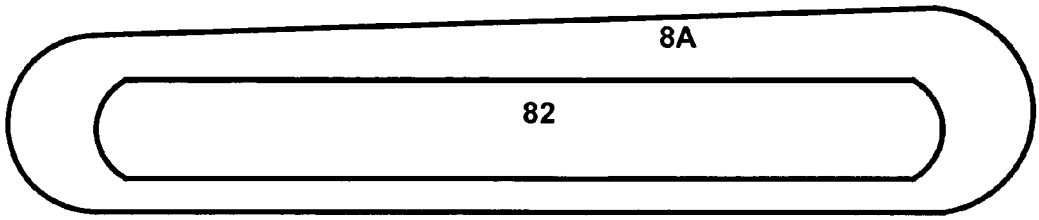
FIGS. 8*a*, 8*b*, 8*c* and 8*d* are schematic presentations of the left side inside view of the lifting arm unit, left side outside view of the lifting arm unit, right side inside view of the lifting arm unit, and left side outside view of the lifting arm unit of the invention.
Figure 8B:
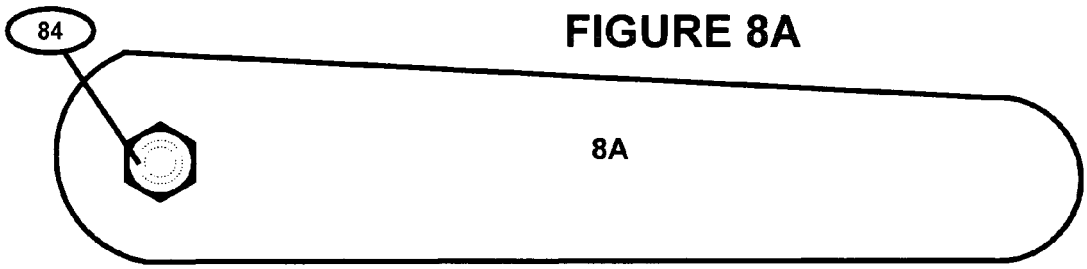
Figure 8C:
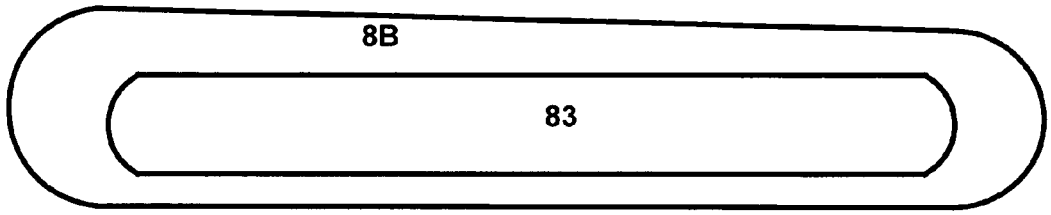
Figure 8D:
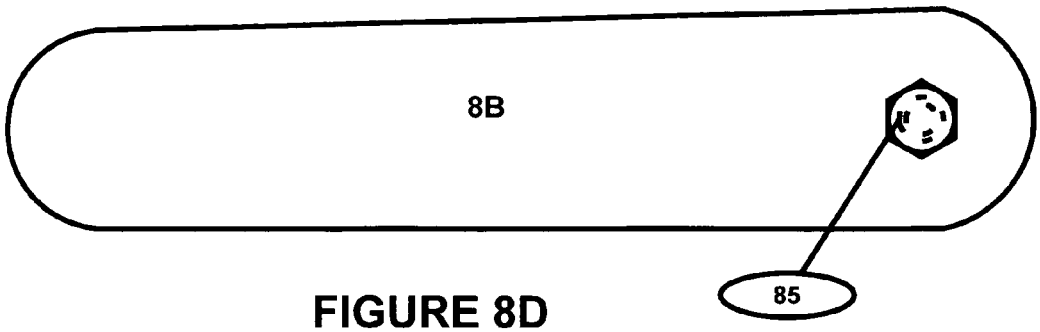

FIGS. 7*a* and 7*b*, shows the external front views of adjustable knee support units 7A and 7B. Knee support unit 7A consists of the horizontal adjustment plate unit 76, the vertical adjustment plate unit 77 and knee support pad 78. Horizontal adjustment plate unit 76 is attached to main trunk unit 1 by means of fasteners {not shown}, vertical adjustment plate unit 77 is attached to horizontal adjustment plate unit 76 by means of fasteners {not shown} and knee support pad 78 is permanently attached to the vertical adjustment plate unit 77 but is allowed to move in the slots by pins secured by a flange unit on each pin within adjustment plate unit 78 (not shown) and is allowed to move in the slots by pins secured by a flange unit on each pin within vertical plate unit 77 (not shown) as shown in FIG. 7A. Knee support unit 7B consists of the horizontal adjustment plate unit 79, the vertical adjustment plate unit 80 and knee support pad 81. Horizontal adjustment plate unit 79 is attached to main trunk unit 1 by means of fasteners {not shown}, vertical adjustment plate unit 80 is attached to horizontal adjustment plate unit 79 by means of fasteners {not shown} and knee support pad 81 is permanently attached to the vertical adjustment plate unit 80 but is allowed to move in the slots by pins secured by a flange unit on each pin within adjustment plate unit 80 (not shown) and is allowed to move in the slots by pins secured by a flange unit on each pin within vertical plate unit 80 (not shown) as shown in FIG. 7B.

In FIGS. 8*a*, 8*b*, 8*c* and 8*d* are shown the external views of the inside and outside lifting arm units 8A and 8B. The inside view of lifting arm 8A shows the overall lifting arm 8A and the gear rack 82 in which the extender connector rod 86 from the extender bar 14A is mated. The outside view of lifting arm 8A shows the elbow joint connector nut 84, which secures elbow joint unit 14A to the lifting arm 8A. The inside view of lifting arm 8B shows the overall lifting arm 8B and the gear rack 83 in which the extender connector rod 87 from the extender bar 14B is mated. The outside view of lifting arm 8B shows the elbow joint connector nut 85, which secures elbow joint unit 14B to the lifting arm 8B. Drive gear 88 {see FIG. 9} engages gear rack 82 and moves lifting arm 8A to assist the patient to be raised to a standing position and extender connector rod 86 {see FIG. 9} allows the lifting arm 8A to move up and down. Drive gear 95 {see FIG. 9} engages gear rack 83 and moves lifting arm 8B to assist the patient to be raised to a standing position and extender connector rod 87 {see FIG. 9} allows the lifting arm 8B to move up and down.

Figure 9A:
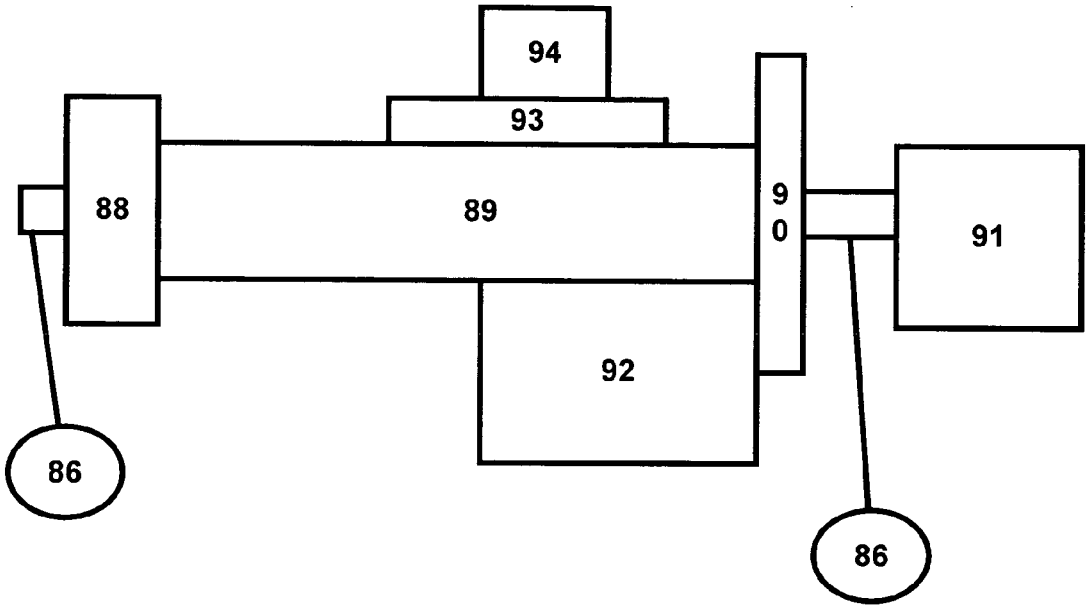
FIGS. 9*a* and 9*b* are schematic presentations of left side extender bar unit and the right side extender bar unit of the invention.
Figure 9B:
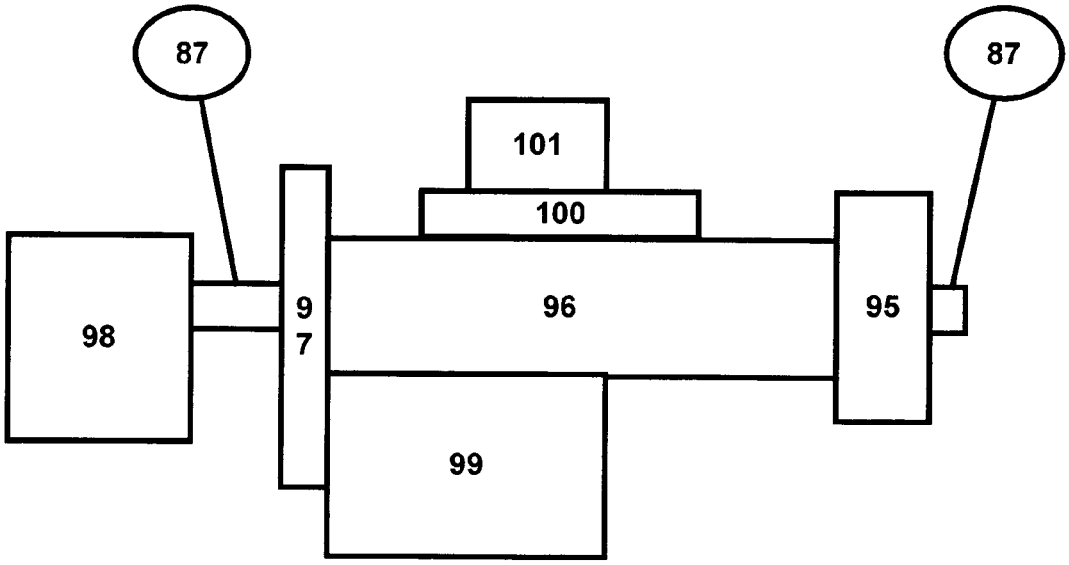

FIGS. 9*a* and 9*b* shows the external views of extender bar units 14A and 14B. The side view of extender bar unit 14A shows extender connector rod 86 which is connected to reversible DC motor unit 91 which is connected to lifting arm 8A. Drive gear 88 is connected to a shaft {not shown} which in turn is connected to a reversible DC motor unit 90 that moves extender arm unit 8A back and forth. Gear rack 93 is connected to sleeve 89, which is the outside covering of extender bar unit 14A. It has a rectangular end and is threaded. Reversible DC motor unit 94 engages gear rack 93 that allows the extender bar unit 14A to move in and out of middle trunk unit 2. Motor units 94 and 92 are fastened to the wall of middle trunk unit 2 to hold extender bar unit 14A in place. Likewise, the side view of extender bar unit 14B shows extender connector rod 87 which is connected to reversible DC motor unit 98 which is connected to lifting arm 8B. It has a rectangular end and is threaded. Drive gear 95 is connected to a shaft {not shown} which in turn is connected to a reversible DC motor unit 97 that moves extender arm unit 8B back and forth. Gear rack 100 is connected to sleeve 96, which is the outside covering of extender bar unit 14B. Reversible DC motor unit 101 engages gear rack 100 that allows the extender bar unit 14B to move in and out of middle trunk unit 2. Motor units 99 and 101 are fastened to the wall of middle trunk unit 2 to hold extender bar unit 14B in place.

Figure 10A:
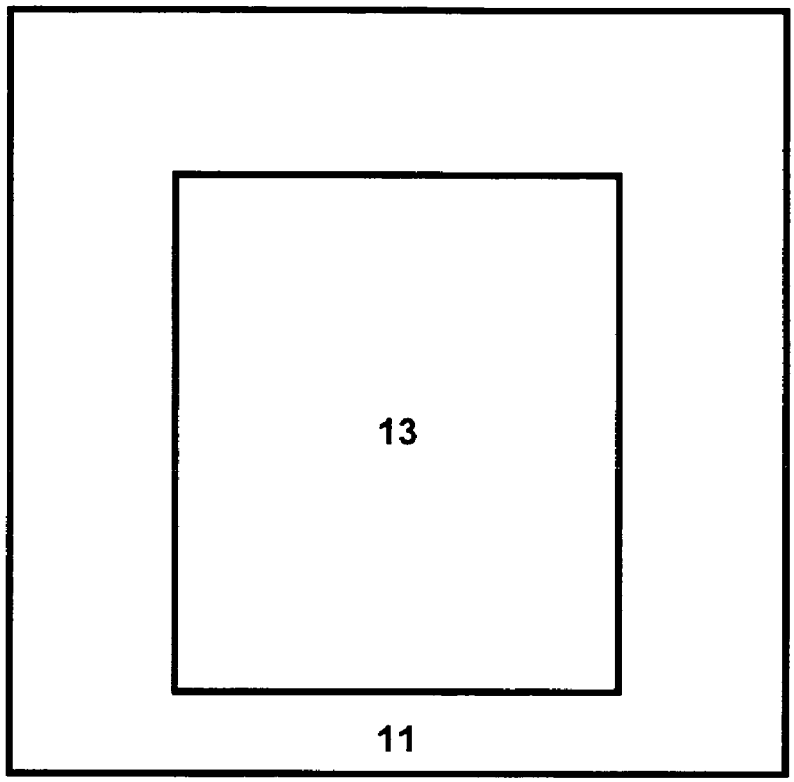
FIGS. 10*a* and 10*b* are schematic presentations of the external view of the winch holder unit and winch unit of the invention.
Figure 10B:
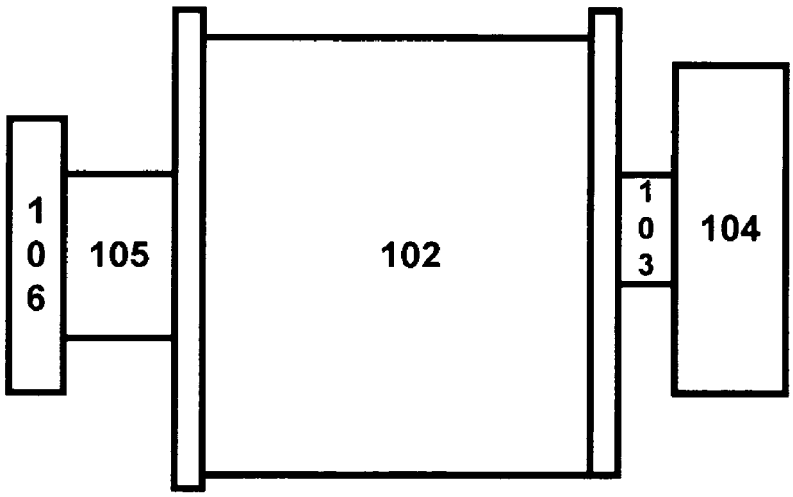

In FIGS. 10*a* and 10*b* are shown external view of the winch holder unit 11 and winch unit 13 also the details of winch unit 13 assembly. As shown in FIG. 4, winch hold unit 11 is fastened to the upper trunk unit 3 by attachment plate 106 and reversible DC motor unit 104. Winch cable {not shown} is attached to reel [102], which in turn is connected to shaft [105 at one end and drive shaft [103] at the other end.

Figure 11:
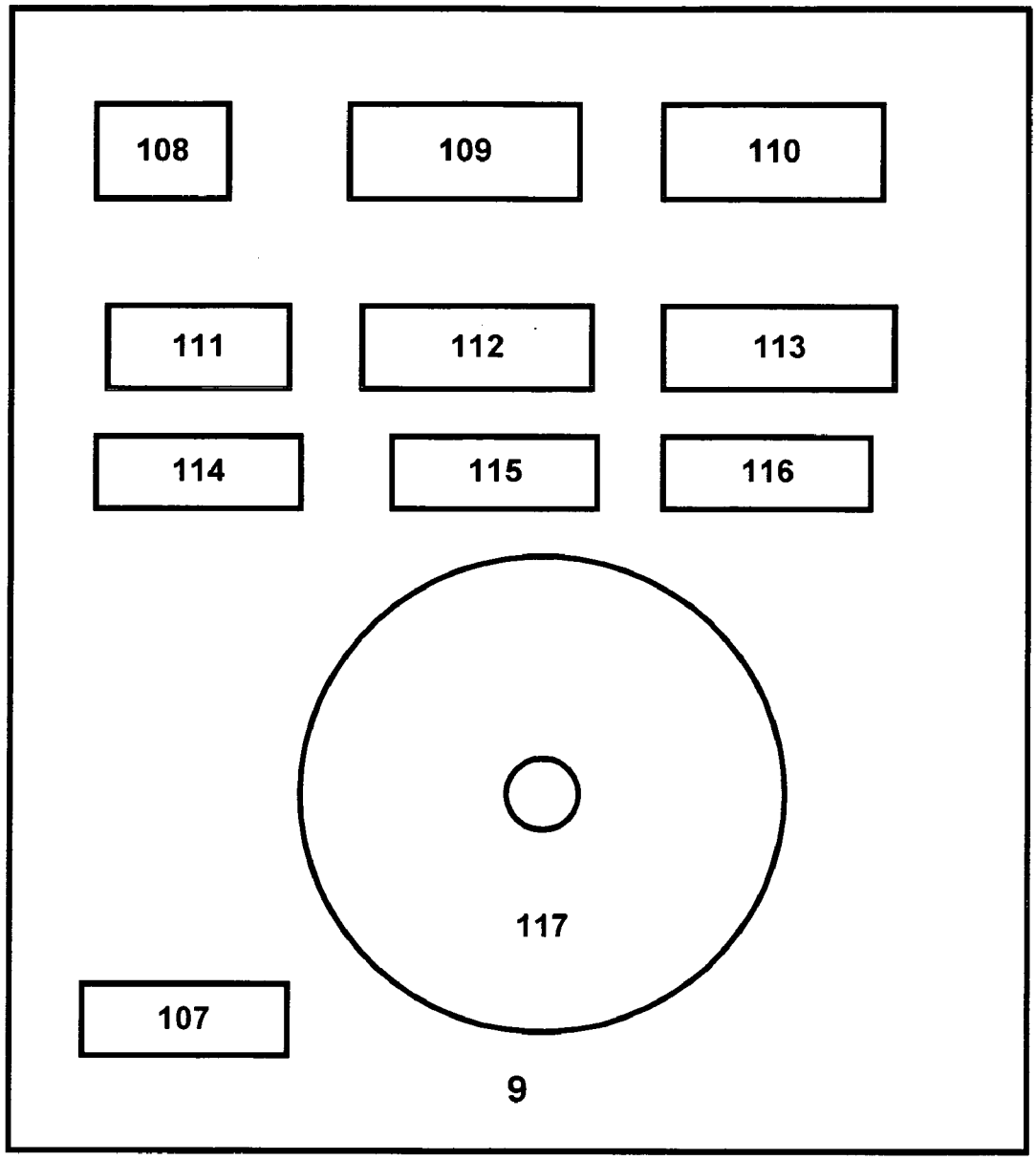
FIG. 11 is an external view of the handheld control unit of the invention.

FIG. 11 shows the external view of the handheld control unit 9. The apparatus switch 107 turns the power on or off to the apparatus, switch 108 which extends or retracts the variable stability fin units A, B and C, switch 109 raises and lowers the middle trunk unit [2], switch 110 raises and lowers upper trunk unit 3, switch 111 controls the in and out movements of extender bar units 14A and 14B, switch 112 controls the in and out movements of lifting arm units 8A and 8B and switch 113 rotates the lifting arm units 8A and 8B in the vertical or horizontal plane or somewhere in between. Switch 115 turns on the power to the winch 13 and switch allows the winch reel 114 to reel in or out the cord/wire as required. Switch 116 set the speed of the apparatus and joystick 117 controls the forward/reverse motion and right and left turns as required.

Figure 12:
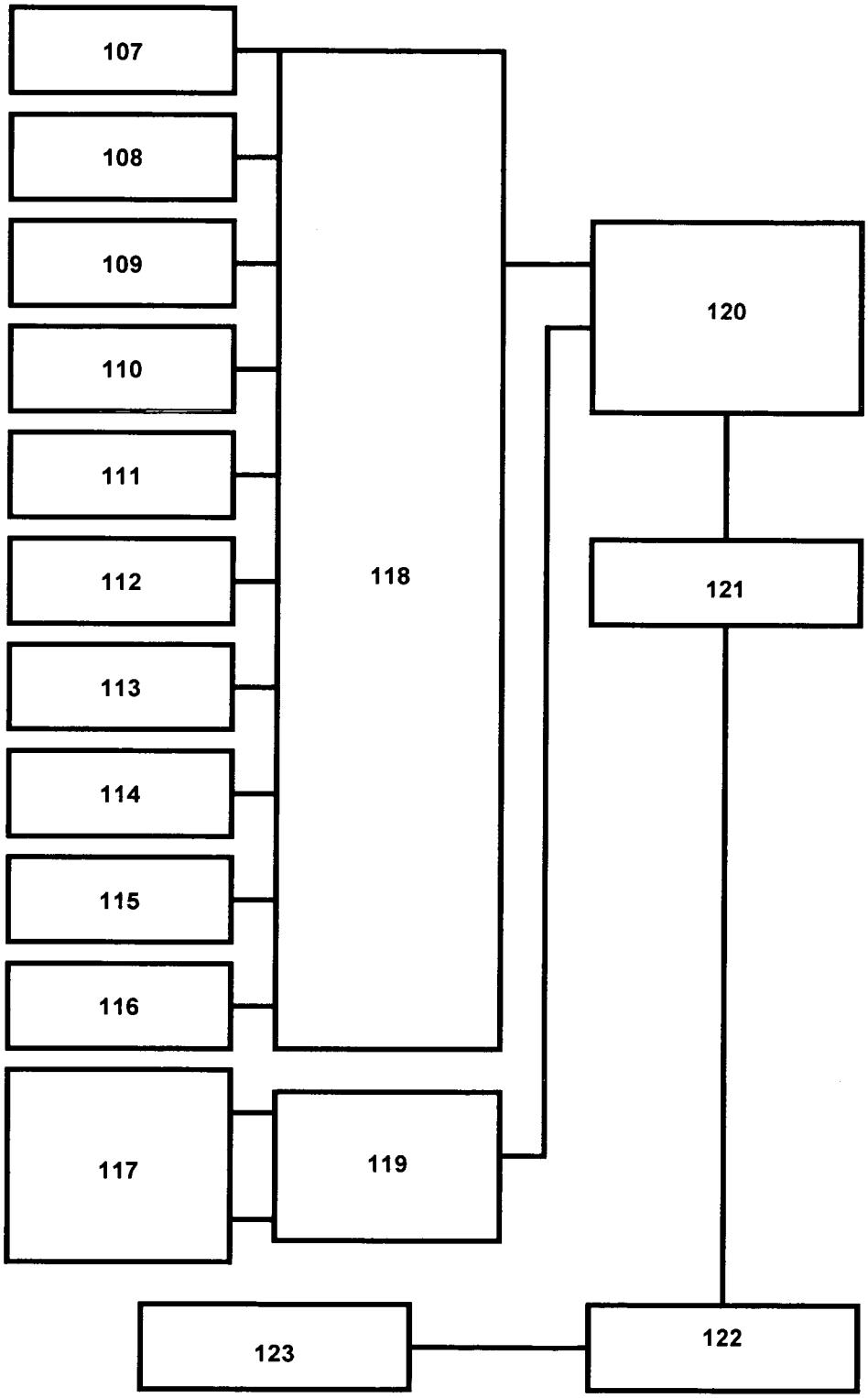
FIG. 12 is a block diagram of a wireless IR embodiment of the invention.
Figure 13:
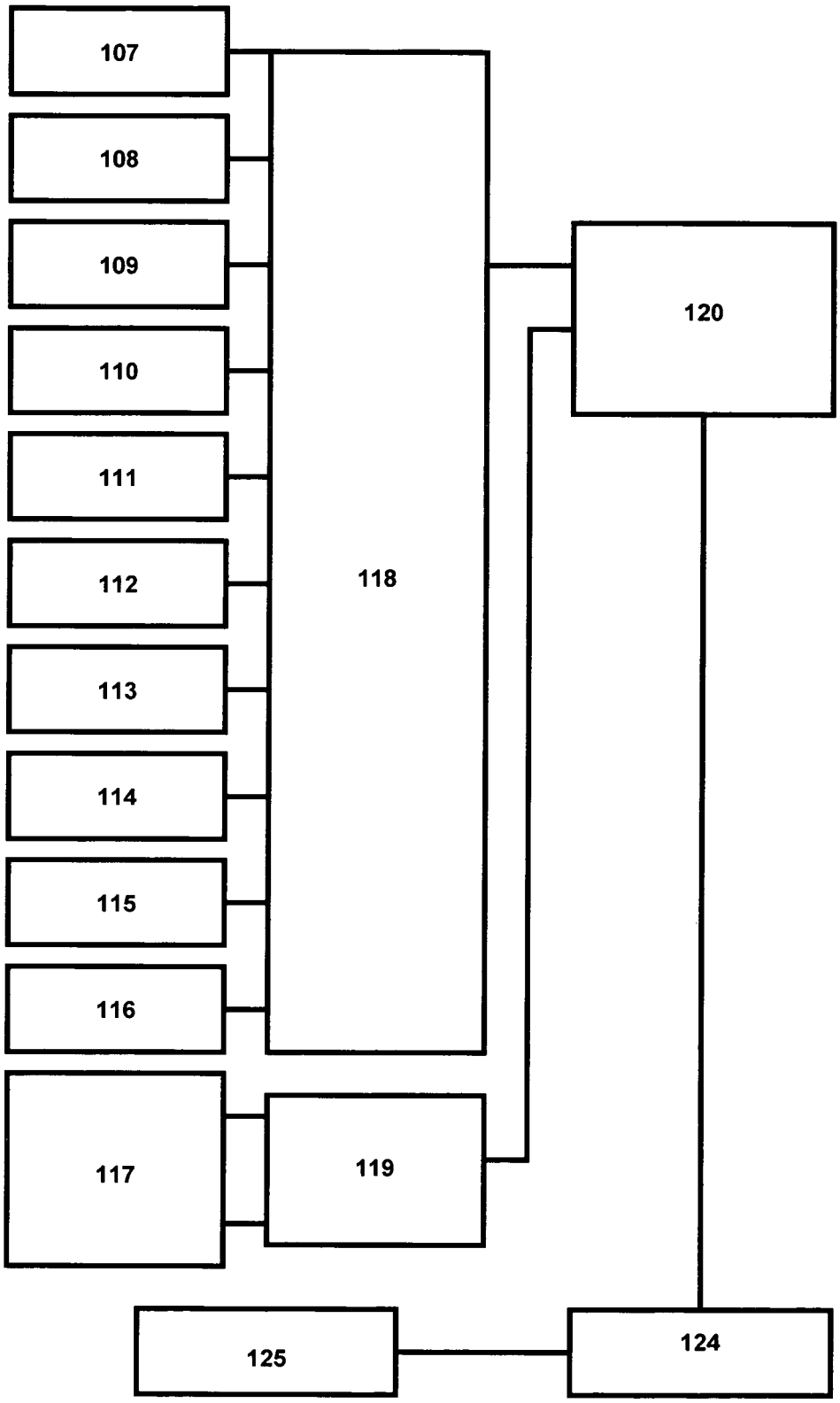
FIG. 13 is a block diagram of a wireless RF embodiment of the invention.

FIGS. 12 and 13 show the two wireless data link methods. The wireless data link can either be of an Infrared (IR) type (FIG. 12) or and Radio Frequency (RF) type (FIG. 13). In either case, the microprocessor 140 is connected to an input/output interface 138. One output from the input/output interface 138 is connected to a data input/output processor 139, this in turn is connected to a IR receiver 153 or a RF receiver 154. The receiver, either 153 or 154, receives data from a remote computer 501 {not shown} or transmitter(s) 123 or 125. Another output from the input/output interface 94 is connected to an input/output receptacle 137. Proper wiring can connect this input/output receptacle 137 directly to the remote computer 501 {not shown}.

As shown in FIG. 12, an IR transmitter unit comprises of the following components: (1) Switch inputs 107 . . . 117, (2) Encoder unit 118, (3) Joystick inputs 117, (4) 2 Channel A/D Converter unit 119, (5) Combiner unit 120, (6) Filter unit 121, (7) Transmitter processor unit 122, and (8) Transmitter/Light source unit 123. Digital data is sent to the combiner unit 120, the output is transferred to the Transmitter Processor 121 and is put into data packets with error correction algorithms, the output activates the transmitter/light source 123.

In FIG. 13, a RF transmitter unit comprises of the following components: (1) Transmitter unit 125, (2) Signal processor/modulator 124, and (3) Combiner unit 120. The transmitter unit 125 provides the modulation of the RF signal waveform. On the transmit side, the transmitter unit 125 accepts outgoing data messages from the signal processor/modulator 125, continuous phase modulates the digital information, up-converts the frequency to RF frequencies, performs frequency hopping, and provides RF power amplification for output to the Transmitter's antenna.

Figure 14:
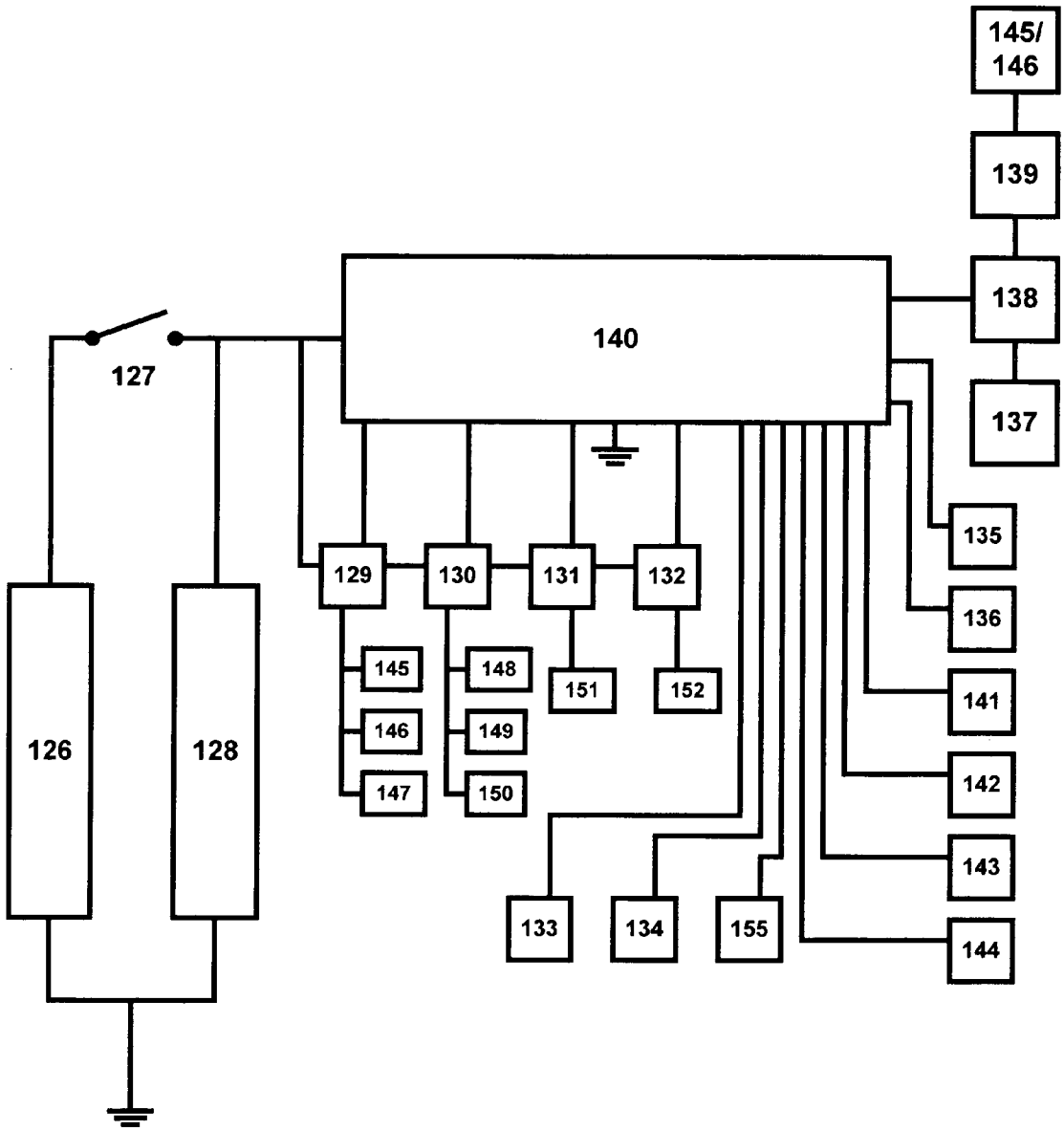
FIG. 14 is a block diagram of the electronic configuration of the invention.

FIG. 14 shows a block diagram of the electronic configuration of the invention. It has a receiver unit 153 or 154 depending if the wireless data is sent by IF or RF. For the IF mode, which includes a light detector 153, (2) Receiver processor 139, and (4) Input/output interface 138. The receiver light detector 153 detects light energy, and the output is sent to the receiver processor 139 to be analyzed for a predetermined time period to detect presence of data and correct the data from any errors that might have been introduced during the transmission of the data. The processed data is sent to the input/output interface 138 for use by microprocessor unit 140 or by the remote computer 501 {not shown}. For the RF mode, the RF receiver 154 accepts RF energy inputs, rejects signals not of interest, downconverts, dehops, amplifies, filters, phase detects, and digitizes the message for output to the signal processor 139. The signal processor performs preamble and message data processing, the data is analyzed for a predetermined time period to detect presence of data and correct the data from any errors that might have been introduced during the transmission of the data. The processed data is sent to the input/output interface 138 for use by some other unit such as the microprocessor 140 or by the remote computer 501 {not shown}. The microprocessor 140 has a executable program that directs the functions of the RF receiver 154. This program provides control of the RF receiver 154, processing of data packets for reception, input data from switch(s)/joystick activation(s), system time, and built-in test and fault detection. The Microprocessor 140 controls the various motors within the invention. Programmable rheostats 129, 130, 131 and 132 control the speed and direction of reversible DC motors 145, 146, 147, 148, 149 and 150 for Stability Fins A, B and C; drive wheel motor 151; and drive wheel motor 152. Middle trunk movement is controlled by motor unit 133, upper trunk movement by motor unit 134, winch motor unit 155, lift arm A motor unit 135 and lift arm B motor unit 136, extender rod A motor unit 141 and extender rod B motor unit 142, and rotate lift arm A motor unit 143 and rotate lift arm B motor unit 144. Also is shown power source 126, power on/off switch 127 and voltage regulator unit 128.

All RF and IR transmissions are subject to noise, interference and fading. Most short-range RF and IR wireless data communications use some form of packet protocol to automatically assure information is received correctly at the correct destination. A packet generally includes a preamble, a start symbol, routing instruct, packet ID, message segment, error correct bits, and other information (if required). Various correction schemes can be employed to minimize transmission errors.

In describing the invention, reference has been made to a preferred embodiment and illustrative advantages of the invention. Those skilled in the art, however, and familiar with the instant disclosure of the subject invention, may recognize that numerous other modifications, variations, and adaptations may be made without departing from the scope of the invention. With these modifications, variations and adaptations can be applied to the various units within the apparatus.

What is claimed is:

1. Apparatus for assisting in movement of an individual from one position to a second position at a first location, and for relocating said individual while in the latter position to a second location comprising:

a housing having a base and during assisting movement of said individual disposed in substantially a vertical orientation along an axis from said base;

stability fin means for positioning said housing in said orientation over a surface and for maintaining said positioning during movement of said housing along said surface to any one of a number of indeterminate positions;

first means carried by said housing for mounting said stability fin means on said housing;

a support plate providing a surface for support of said individual in each of said positions;

second means for mounting said support plate in position near said base to extend substantially laterally in direction away from and along said housing;

first and second lifting arms, said first lifting arm disposed on one side of said housing remote from said base and said second lifting arm disposed substantially opposite on the other side of said housing;

a gripping instrumentality supported by each said lifting arm unit adapted to be grasped by said individual during stages of relocating movement; and extender unit means supported by said housing and supporting said first and second lifting arm, said extender unit means including controlling means for locating the disposition of said gripping instrumentality to any position along a substantially vertical axis and along at least two substantially horizontal axes that are perpendicular to each other relative to said individual being assisted in movement.

2. The apparatus of claim 1 wherein said housing includes a lower housing component and a middle housing component for supporting said extender unit means.

3. The apparatus of claim 2 wherein said housing includes a top housing component, and fourth means intermounting said lower, middle and top housing components whereby said middle may be telescopically retracted into and withdrawn from said lower housing component, and said top housing component may be telescopically retracted into and withdrawn from said middle housing defining operative and inoperative conditions of said apparatus.

4. The apparatus of claim 3 further comprising a winch holder unit, fifth means for mounting said winch holder unit within said top portion, said winch holder unit including a reel mechanism and hook and line adapted for attachment to a harness capable of receipt around the individual's torso, and said reel mechanism operated for retrieving said line and drawing on said harness for further assist in relocating said individual to said other position.

5. The apparatus of claim 1 wherein said stability fin means comprises a plurality of stability fin units arranged substantially equidistantly around said housing, each said stability fin unit including a first member extending in an outward and downward orientation from a first end to a second, remote end.

6. The apparatus of claim 5 wherein each stability fin unit includes a second member extending in an outward orientation from a first end to a second, remote end, said means also connecting said remote end of said second member to said remote end of said first member, and seventh means connecting said first end of said first and second members to said housing.

7. The apparatus of claim 6 wherein said first and second member of each stability fin includes a plurality of individual sub members, and eighth means supporting each sub member of each stability fin in a manner that the sub members from said remote end may be telescopically received within the next adjacent sub member toward said first whereby said first and second members of a stability fin may be reduced in length and returned to any extended radial length required to satisfy requirements for in relocating said individual to said second location.

8. The apparatus of claim 7 wherein said sub members of each stability fin are of substantially equal length.

9. The apparatus of claim 7 further including an opening in the surface of said lower housing component, a fixed plate located within said housing near said opening, and ninth means mounting said first and second members received within said opening on said fixed plate during telescoping movement and for pivotal movement from said supporting position within said opening.

10. The apparatus of claim 7 wherein said stability fins include three sub members.

11. The apparatus of claim 2 further comprising a pair of knee pad units, and tenth means carried by said housing within said lower portion for mounting each knee pad units, said tenth means mounting said knee pad units for movement within a plane to an indeterminate number of dispositions according to the physical dimensions and weight of said individual.

12. The apparatus of claim 11 wherein said tenth means includes a first and second plate, at least one slot in each plate, and a pin extending through said slots, flange means on opposite ends of said pin for support in and movement along said slots when said plates are disposed in position with the slot in one plate arranged perpendicular to said slot in said other plate.

13. The apparatus of claim 2 further comprising a chest protector pad, eleventh means carried by said housing for mounting said chest protector pad on said middle portion.

14. The apparatus of claim 1 wherein said controlling means includes a pair of controlling rods located in substantially coaxial relation and extending radially of said axis, each lifting arm fixedly connected to a respective one of said controlling rods for movement to and between angular dispositions following a first rotational movement input to each said controlling rod.

15. The apparatus of claim 1 wherein said controlling means includes a pair of controlling rods located in substantially coaxial relation and extending radially of said axis, a sleeve mounted coaxially on each said controlling rod for rotational movement independently of any rotational movement of its support, a drive gear mounted on said sleeve, and said lifting arms each including a gear track along a surface facing said housing, each said drive gear cooperating in said gear track for movement of said lifting arms to and between linear dispositions toward and away from said individual.

16. The apparatus of claim 14 wherein said controlling rods support coaxially a drive gear mounted for rotational movement together with and/or independently of said first rotational movement, and said lifting arms each including a gear track along a surface facing said housing, each said drive gear cooperating in said gear track for movement of said lifting arms to and between linear dispositions toward and away from said individual.

17. The apparatus of claim 1 wherein said controlling means includes a pair of controlling rods located in substantially coaxial relation and extending radially of said axis, and further comprising twelfth means for extending and retracting said controlling means thereby to locate each said lifting arm in any one of an indeterminate number of positions laterally of said housing determined by the physical make-up of said individual.

18. The apparatus of claim 1 further including power means connected to the stability fin and first & second lifting arms.

19. The apparatus of claim 18 further including a remote means for controlling operation of said power means.

* * * * *